United States Patent [19]

Dillon

[11] 4,125,229

[45] Nov. 14, 1978

[54] APPARATUS FOR RESTARTING A BROKEN THREAD OR YARN STRAND DURING A WINDING PROCESS

[75] Inventor: Roy E. Dillon, Stoneville, N.C.

[73] Assignee: Macfield Texturing, Madison, N.C.

[21] Appl. No.: 851,697

[22] Filed: Nov. 15, 1977

[51] Int. Cl.[2] ..... B65H 54/02

[52] U.S. Cl. ..... 242/18 R; 242/18 PW; 242/129.51

[58] Field of Search ..... 242/18 R, 18 DD, 18 PW, 242/18 EW, 129.51

[56] References Cited

U.S. PATENT DOCUMENTS

| | | | |
|---|---|---|---|
| 2,776,098 | 1/1957 | Baumann et al. | 242/129.51 |
| 3,034,736 | 5/1962 | Rhein, Jr. | 242/18 R |
| 3,433,433 | 3/1969 | Pospisil et al. | 242/129.51 |
| 3,921,921 | 11/1975 | Katayama et al. | 242/18 PW X |
| 3,941,320 | 3/1976 | Strunk | 242/129.51 X |
| 4,042,188 | 8/1977 | Richards | 242/129.51 |

FOREIGN PATENT DOCUMENTS

| | | | |
|---|---|---|---|
| 1,342,286 | 9/1963 | France | 242/129.51 |

*Primary Examiner*—Stanley N. Gilreath

[57] ABSTRACT

On a texturing machine such as a false twist machine a broken strand of thread or yarn is restarted during a winding process by means of a uniquely formed end cap which mounts the take-off end of the winding spool to the take-up holder arm. The end cap includes a shoulder extending in an axial direction beyond the rim of the take-off end of the spool and a hook-like tab extending outwardly over the shoulder which picks up the broken yarn end and guides the yarn around the shoulder portion for several rotations. After wrapping the yarn around the shoulder traversing of the yarn along the spool is carried out until the interrupted yarn package is completed. When the package is complete the spool is removed from the winding machine, leaving the end cap on the machine. During inspection the aforesaid two ends are tied together completing the repair of the broken end. The take-off end cap is further provided with a plurality of radial slits extending inwardly from spaced points around the periphery to insure a tight fit between the cap and the take-off end of the winding spool.

3 Claims, 3 Drawing Figures

APPARATUS FOR RESTARTING A BROKEN THREAD OR YARN STRAND DURING A WINDING PROCESS

BACKGROUND OF THE INVENTION

This invention relates to the field of textile technology as particularly related to the process of winding thread or yarn onto a spool to form a yarn package after occurrence of some fiber preparation operation during which yarn breakage is likely to occur. An example of such is in a false-twist machine. Although the term "yarn" will be used for illustrative purposes herein it should be understood to include threads or filaments of many fiber types.

Traditionally during a texturing operation when a yarn strand is broken before completion of the yarn package, the imcompletely filled spool is removed from the winding mahine and a new package is begun. Previously there has been no satisfactory way of replacing broken yarns in such operations. Depending on the weight of the incomplete yarn package the package with a broken yarn has been treated one of two ways. For example if the weight of the yarn is less than about 2½ pounds the package generally is removed from processing and sent to a rewind operation. This rewinding of incomplete yarn packages is an inexpensive loss to the manufacturer (10–15 cents/pound). If, on the other hand, the weight of the package is greater than 2½ pounds when the breakage occurs the yarn is shipped on; however, it becomes expensive to the manufacturer because spools are expensive and less than full packages increase the number of spools required.

While it may seem to be an easily solved problem to tie broken ends, such has not been possible because previously the only way to bring the broken ends out was at the base end of the spool which was provided with a tail-end starting device. It is not feasible to tie broken ends at the base end of the spool because takeoff in the next operation is from the opposite end.

To the inventor's knowledge there has been no apparatus and no process directed to the resolution of the above problem.

SUMMARY OF THE PRESENT INVENTION

The present invention is directed to a method and apparatus for repairing a broken end of a yarn, thread, or filament strand which was broken during processing in some type of textile apparatus as a false-twist machine. The present invention allows for the completion of the yarn package although interrupted during winding by breakage of the yarn strand, an act which was not previously feasible.

The apparatus includes a uniquely designed end support cap mounted on the package support arm at the let-off end of the winding spool. The end cap includes a shoulder between the flange of the cap and the cylindrical spool-engaging surface which receives the two broken ends of a yarn strand while the yarn is wrapped several times around the cap shoulder before continuing the transverse controlled winding operation. Further, a tab extends from the flange out over the shoulder to grab the yarn initially and guide it onto the shoulder.

The shoulder portion of the end cap is a shelf-like portion of the cap which, during winding, is seated against the let-off end of the winding spool. As described above the yarn or thread is wrapped around this shoulder to support and isolate the two broken ends until the spool is removed from the winder. At that point the end cap remains on the package support arm and the yarn which was wound around the shoulder hangs loose until it is tied off during the inspection or other subsequent process.

Because the cap remains on the support arm and is fitted repeatedly to many winding spools, the diameter of each of which may vary slightly, it was essential to provide a way to insure a continually snug fit of the cylindrical spool-engaging portion of the cap into the let-off end of the spool. To accomplish this objective the diameter of the cylindrical spool-engaging portion is made as large as the largest inner diameter of the spools. Then a series of narrow radial slots or slits are formed to extend inwardly from the peripheral edge of the flange through the shoulder and cylindrical spool-engaging portions. These slots impart resilience to the cap permitting it to be repeatedly compressed and fitted into the end of spools of different diameter and held securely therein by friction.

The above-described end cap therefore allows the winding process to be continued after a strand breaks and completion of the yarn package to its desired weight.

The method of repairing a broken strand of yarn includes the steps of: (1) locating the broken supply end, feeding it through the machine to the vacuum inlet adjacent the winding position; (2) restarting machine; (3) manually removing a length of package yarn from the supply package to form several wraps around the shoulder of the take-off support cap; (4) wrapping several turns of supply yarn around the shoulder; (5) reingage supply yarn into transverse guide and resume winding to complete package. The yarn package is then forwarded to the inspection department where the trailing ends of the yarn package are tied off.

It should be emphasized at this point that both broken ends of the yarn strand are wrapped and temporarily held at the take-off end of the spool which is opposite the base end of the spool where the transfer end of the yarn is initially picked up for winding. Therefore when the yarn is subsequently positioned on a creel for fabric forming, the tied broken ends will be at the upper or take-off end of the yarn package causing no snags or breaks as the yarn is pulled off the package.

It is therefore an object of the present invention to provide an apparatus for tying a strand of yarn that has broken during the fabric preparation or texturing process.

A further object of the present invention is to provide an apparatus for completing a yarn package which has been interrupted by yarn breakage during an attendant process.

Another object of the invention is to provide an apparatus for defining and separately maintaining the broken yarn ends on a yarn package before they are tied off during the inspection process.

Still another object of the present invention is to provide an apparatus for use on a yarn processing machine which facilitates the tying of broken yarn strands at the take-off end of the package.

DETAILED DESCRIPTION OF A PREFERRED EMBODIMENT

Figure 1:
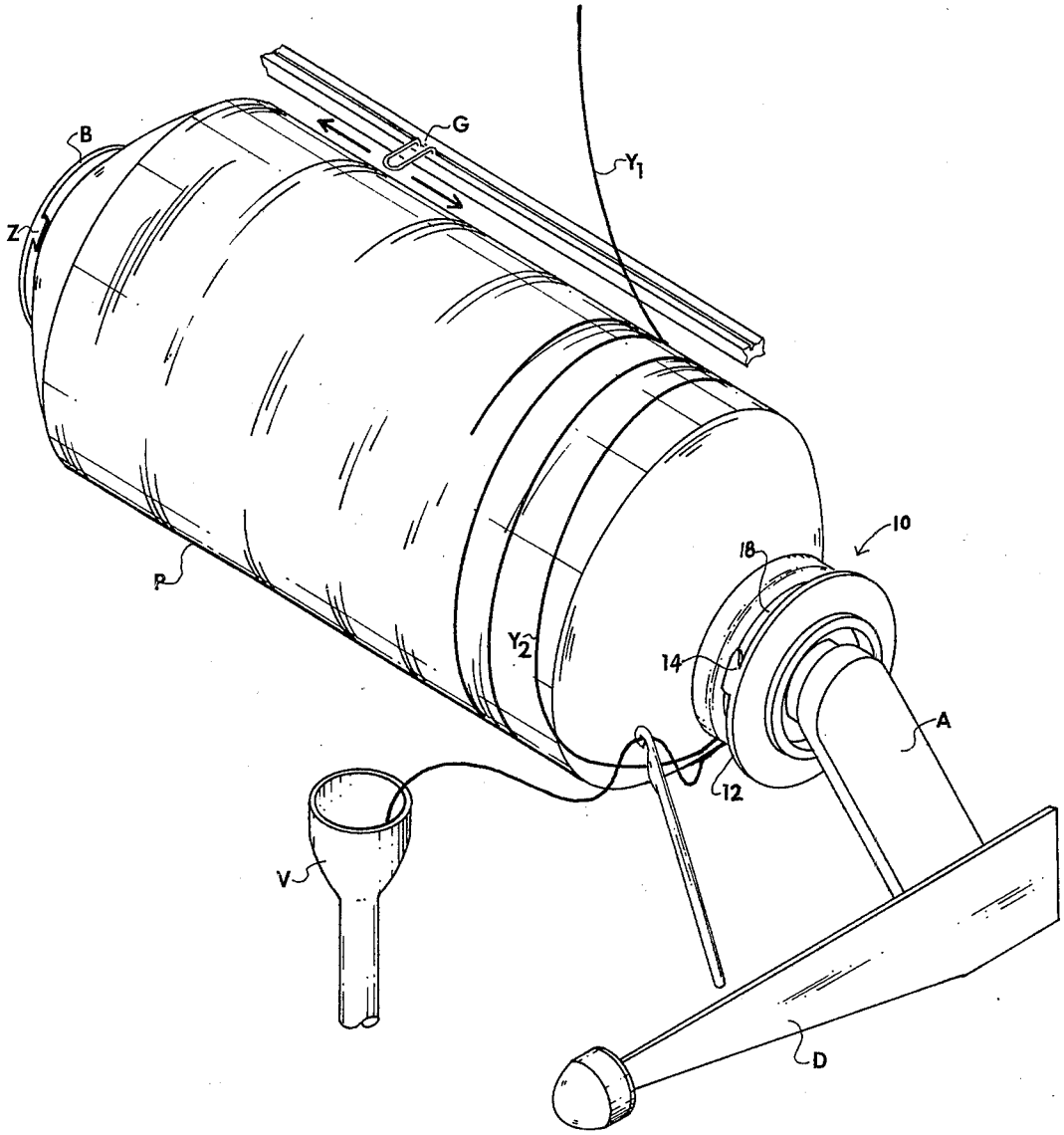
FIG. 1 is an environmental view in perspective of the present invention.

Turning now to the drawings, the present invention is practiced in conjunction with the processing or preparing of yarn such as on a false-twist texturing machine. The description will proceed with reference to a false-twist texturing operation although this technique is applicable to many yarn preparation operations. In such texturing machines various operations occur to the raw yarn such as heating, crimping, twisting, setting, and the like. The yarn is then taken up on a package similar to the manner illustrated in FIG. 1. At the take-up position the yarn package P is held between and caused to rotate by a pair of package holder arms A. Each package P is wound on a tube T. A base cap B and take-off cap 10 are mounted on opposite arms A and hold tubes T therebetween. A doffing handle D activates one of the arms A to separate take-off cap 10 from base cap B in a conventional, well-known manner. A vacuum tube is conventionally position beneath the package for removal of small ends and the like.

The yarn strand Y1 as fed from the yarn supply is guided by the traverse guide G in a traversing motion across the tube T to complete the yarn package P. When winding of the package P is begun, the yarn strand is picked up at a point adjacent the base cap B and wrapped several turns around the tube T leaving a transfer tail Z extending beyond the yarn package P. This transfer tail Z is picked up at a later point when the yarn is to be removed from the tube during knitting, weaving, or the other fabric construction.

At various points or times during yarn processing, particularly when the yarn is subjected to stress from heat, tension, etc. it is likely that the strand will break. At that time the machine is automatically cut off by a stop-motion mechanism and the winding is stopped. According to conventional practice at this time the incomplete yarn package P is removed from the machine and a new package begun. According to the present method and apparatus, however, the broken yarn is picked up and isolated on the take-off end of the tube and restarted to complete the package.

Upon stoppage of the machine an operator is dispatched to effect tying of the broken yarn and resumption of the texturing operation. The first step is to locate and feed the supply yarn Y1 through the machine to the vacuum tube V without feeding through the traverse guide G. The partially formed package P is manually backed off to provide some slack yarn Y2. A few turns of the yarn Y2 are wrapped around the shoulder 14 of the take-off support cap 10. The operator then restarts the texturing machine, picks up the supply yarn Y1 with a hook-like implement and holds the yarn in close proximity to the tab 16 on take-off cap 10. The tab will engage and grab the yarn Y1 and cause it to wrap on shoulder 14 atop the slack yarn Y2 from the package already there wrapped. The operator then reingages supply yarn Y1 with the traverse guide and normal operation resumes.

Upon completion of the package it is doffed and inspected. During inspection the ends Y1 and Y2 can then be tied. Subsequently in fabric formation the tied ends will leave the package from the take-off end with no problem.

Figure 3:
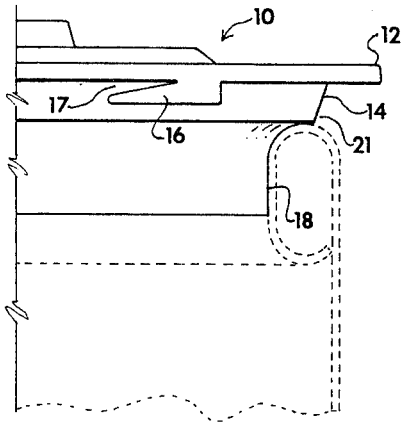
FIG. 3 is an enlarged partial side view of the take-off end cap illustrated in FIG. 2.
Figure 2:
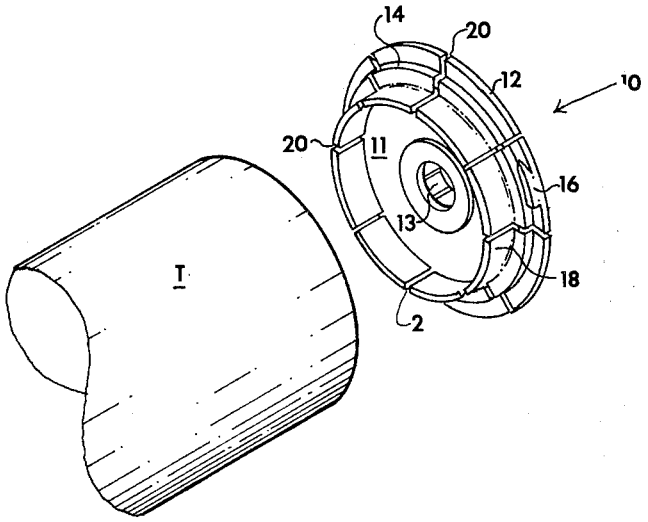
FIG. 2 is a perspective view of a preferred embodiment of a take-off end cap which connects one end of a yarn package to the arm of the take-up holder.

Turning now to FIGS. 2 and 3 there is illustrated the take-off end cap 10 according to the present invention. The cap 10 is formed of a generally disc-shaped body portion 11 having an attachment means 13 for connecting the cap to the arm A. The body portion 11 generally includes an outer flange 12, a shoulder or intermediate portion 14, which separates the flange from a cylindrical, tube-engaging portion 18. A tab 16 extends from flange 12 out over shoulder 14 and forms a notch 17 which grabs the yarn end and guides it onto shoulder 14 as the winding tube rotates.

According to a preferred embodiment the end cap 10 is molded from a plastic material which cures to a very rigid hard state. In use the take-off support cap is semi-permanently mounted on the winding arm A which supports the take-off end of tube T and remains in place there through the forming of successive yarn packages 50. The flange 12 is of a diameter slightly greater than the tube T, while shoulder 14 is slightly tapered from the flange radially inwardly toward the rounded end of the tube. This combination forms a recess 21 (FIG. 3) bound by the flange 12, shoulder 14, and the take-off end of tube T, and permits easy wrapping of yarns Y1 and Y2 on the shoulder 14, but allows easy removal of the wrapped yarn when the package is doffed. Because the tubes T may vary slightly in effective inner diameter to ensure a generally snug engagement of the tubes 20 on the surface 18, the cap 10 is provided with a plurality of slots 20 extending, as illustrated, radially from the rim 14 through the shoulder 14 and the tube engaging portion 18. The radius of the tube engaging portion is so formed as to be equal or slightly greater than the largest inner diameter to be expected in the tubes. The slots 20 permit a slightly contraction of the spool-engaging portion so it may be slipped into the opening in the let-off end of the tube then slightly expands to hold the tube snugly in place. The cap will thus adjust to fit each tube regardless of its inner diameter and may be used continuously for extended periods of time before wearing down or losing its shape.

The shoulder portion 14 as seen in FIGS. 2 and 3 seats immediately against the let-off end of tube 10 and acts as a retainer or support for the first several wraps of the restarted yarn to maintain them separately from the body of the yarn package.

A detailed view of the pick-up tab 22 illustrates that it extends axially toward tube 10 from the inner surface of flange 12 whereby a notch 17 is formed. It is into this notch 23 that the broken end of supply yarn Y1 is introduced to resume the operation.

Although the above method and apparatus is illustrated and described for use on a false-twist machine and is directed to one embodiment of a take-off support cap, it is apparent that various changes and modifications might be made withut departing from the scope of the invention which is to be limited in the claims below.

What is claimed is:

1. In a thread or yarn processing apparatus of the type including a take-up mechanism with a cylindrical, yarn receiving tube, wherein the tube includes a base end where a transfer tail is secured, and an opposite take-off end, an improved take-off end cap removably attached to the winding mechanism and engageable to the take-off end of the spool, said end cap including:

(a) a generally disc-shaped main body portion having means for attaching said cap to the take-up mechanism adjacent the take-off end of said tube, and having an inner surface facing the take-off end of the tube;

(b) a cylindrical, tube engaging surface having a diameter at least as great as the effective inner diameter of the take-off end of the spool;

(c) a flange extending radially from said body portion and having a diameter greater than the diameter of said tube engaging surface and greater than the outer diameter of the tube;

(d) an annular shoulder portion connecting said flange and said tube engaging surface, said shoulder having a diameter greater than that of the tube engaging surface, smaller than the outer diameter of the take-off end of the tube, and smaller than the diameter of said flange, such that when the tube is emplaced on the cap, said shoulder forms a recess between the tube end and said flange; and (e) yarn pick-up means associated with said flange such that during the take-up process a yarn positioned adjacent said flange will be picked up and caused to be wrapped around said shoulder portion to form a trailing end from the yarn supply which is tied off at a later time.

2. The improved take-off end cap according to claim 1 wherein said shoulder is tapered inwardly from a point of greatest diameter adjoining said flange to a point of least diameter adjacent said tube.

3. The improved take-off end cap according to claim 1 wherein said yarn pick-up means comprises a tab depending from said flange, extending inwardly toward said tube and out over said shoulder, thereby forming a notch which engages the supply yarn when held closely thereto and guides said yarn into said recess.

* * * * *